US012253341B1

(12) United States Patent
Minguy

(10) Patent No.: US 12,253,341 B1
(45) Date of Patent: Mar. 18, 2025

(54) ELECTRO-OPTICAL INFRARED (EOIR) SENSOR INTERFACE AND PROCESSING ON A PROGRAMMABLE REAL TIME UNIT (PRU)

(71) Applicant: BAE Systems Information and Electronic Systems Integration Inc., Nashua, NH (US)

(72) Inventor: Connor Minguy, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 79 days.

(21) Appl. No.: 18/458,626

(22) Filed: Aug. 30, 2023

(51) Int. Cl.
*F42B 15/01* (2006.01)
*F41G 7/22* (2006.01)

(52) U.S. Cl.
CPC ..... *F42B 15/01* (2013.01); *F41G 7/2246* (2013.01); *F41G 7/2293* (2013.01)

(58) Field of Classification Search
CPC ..... F42B 15/01; F41G 7/2246; F41G 7/2293
See application file for complete search history.

(56) References Cited

U.S. PATENT DOCUMENTS

| | | | | |
|---|---|---|---|---|
| 7,190,304 | B1 | 3/2007 | Carlson | |
| 7,868,276 | B2 | 1/2011 | Grimshaw et al. | |
| 7,913,606 | B2 | 3/2011 | Schneider et al. | |
| 7,946,209 | B2 | 5/2011 | Schneider et al. | |
| 7,975,593 | B2 | 7/2011 | Schneider et al. | |
| 8,084,726 | B2 * | 12/2011 | Hanlon | F42B 10/663 244/3.21 |
| 8,162,262 | B2 | 4/2012 | Kutzmann et al. | |
| 8,373,105 | B2 | 2/2013 | Eiane et al. | |
| 8,563,908 | B1 * | 10/2013 | Lew | G06F 18/253 702/152 |
| 8,653,434 | B2 | 2/2014 | Johnson et al. | |

(Continued)

FOREIGN PATENT DOCUMENTS

WO 2020117384 A2 6/2020

OTHER PUBLICATIONS

"Application Note: PRU Subsystem Features Comparison"; no author given; published by Texas Instruments; Dallas, TX, USA; Oct. 2022. (Year: 2022).*

(Continued)

*Primary Examiner* — Bernarr E Gregory
(74) *Attorney, Agent, or Firm* — Sand, Sebolt & Wernow LPA

(57) ABSTRACT

A guidance system for a guided munition has an inertial measurement unit (IMU) or another type of first sensor on the guided munition, electro-optical/infrared (EO/IR) sensor on the guided munition, and a guidance computer assembly (GCA) having a Programmable Real-Time Unit Industrial Communication SubSystem (PRU-ICSS), wherein the PRU-ICSS is in operative communication with the IMU or another type of first sensor and the EO/IR. The PRU-ICSS has a first Programmable Real-Time Unit (PRU), wherein the first PRU is programmed to receive and process input data from the IMU or another type of first sensor on the guided munition, and the PRU-ICSS has a second PRU, wherein the second PRU is programmed to receive and process input data from the EO/IR sensor on the guided munition.

20 Claims, 11 Drawing Sheets

(56) References Cited

U.S. PATENT DOCUMENTS

| | | | | |
|---|---|---|---|---|
| 8,686,329 | B2 | 4/2014 | Barry et al. | |
| 8,754,352 | B2 | 6/2014 | Pietrzak et al. | |
| 8,895,908 | B2 | 11/2014 | Barry et al. | |
| 10,077,970 | B2 | 9/2018 | Steenson, Jr. et al. | |
| 10,259,560 | B2 | 4/2019 | Ivans et al. | |
| 10,640,215 | B2 | 5/2020 | Ivans | |
| 10,814,974 | B2 | 10/2020 | Randall | |
| 11,067,372 | B2 | 7/2021 | Schorr et al. | |
| 11,168,959 | B2 | 11/2021 | Frey, Jr. et al. | |
| 11,287,222 | B2 | 3/2022 | Janik | |
| 11,287,233 | B2 | 3/2022 | Zemany et al. | |
| 11,340,052 | B2 | 5/2022 | Cleveland | |
| 11,597,512 | B2 | 3/2023 | Randall | |
| 2008/0105113 | A1 | 5/2008 | Schneider et al. | |
| 2009/0109063 | A1 | 4/2009 | Grimshaw et al. | |
| 2010/0025523 | A1 | 2/2010 | Kutzmann et al. | |
| 2011/0041674 | A1 | 2/2011 | Schneider et al. | |
| 2011/0083547 | A1 | 4/2011 | Schneider et al. | |
| 2011/0176214 | A1 | 7/2011 | Eiane et al. | |
| 2012/0060672 | A1 | 3/2012 | Grigg | |
| 2012/0074256 | A1 | 3/2012 | Pietrzak et al. | |
| 2012/0080583 | A1 | 4/2012 | Johnson et al. | |
| 2012/0119014 | A1 | 5/2012 | Barry et al. | |
| 2013/0177026 | A1* | 7/2013 | Soni | G06F 11/1004 370/463 |
| 2014/0312575 | A1 | 10/2014 | Barry et al. | |
| 2018/0079482 | A1 | 3/2018 | Ivans et al. | |
| 2018/0164076 | A1 | 6/2018 | Steenson, Jr. et al. | |
| 2019/0055021 | A1 | 2/2019 | Ivans | |
| 2019/0369996 | A1* | 12/2019 | Leyrer | G06F 12/0875 |
| 2019/0370207 | A1* | 12/2019 | Leyrer | G06F 11/1004 |
| 2020/0062385 | A1 | 2/2020 | Randall | |
| 2020/0304611 | A1* | 9/2020 | Leyrer | G06F 5/065 |
| 2020/0340787 | A1 | 10/2020 | Zemany et al. | |
| 2021/0033371 | A1 | 2/2021 | Frey, Jr. et al. | |
| 2021/0055085 | A1 | 2/2021 | Snavely | |
| 2021/0063127 | A1 | 3/2021 | Cleveland | |
| 2021/0102790 | A1 | 4/2021 | Schorr et al. | |
| 2021/0172717 | A1 | 6/2021 | Schorr et al. | |
| 2021/0253238 | A1 | 8/2021 | Randall | |
| 2021/0278174 | A1 | 9/2021 | Janik | |

OTHER PUBLICATIONS

"PRU-ICSS / PRU_ICSSG Getting Started Guide on TI-RTOS"; no author given; published by Texas Instruments; Dallas, TX, USA; Jan. 2019. (Year: 2019).*

"TI Designs: TIDA-01555"; no author given; published by Texas Instruments; Dallas, TX, USA; Jan. 2019. (Year: 2019).*

* cited by examiner

52

| | | | | | | | |
|---|---|---|---|---|---|---|---|
| D15 | UART1_TXD | uart1_txd | 0 | O | Z | H | 7 |
| | | mmc2_sdwp | 1 | I | | | |
| | | dcan1_rx | 2 | I | | | |
| | | I2C1_SCL | 3 | I/OD | | | |
| | | pr1_uart0_txd | 5 | O | | | |
| | | pr1_pru0_pru_r31_16 | 6 | I | | | |
| | | gpio0_15 | 7 | I/O | | | |
| D16 | UART1_RXD | uart1_rxd | 0 | I | Z | H | 7 |
| | | mmc1_sdwp | 1 | I | | | |
| | | dcan1_tx | 2 | O | | | |
| | | I2C1_SDA | 3 | I/OD | | | |
| | | pr1_uart0_rxd | 5 | I | | | |
| | | pr1_pru1_pru_r31_16 | 6 | I | | | |
| | | gpio0_14 | 7 | I/O | | | |

56

FIG.4

58

| Int Number | Acronym/Name | Source | Signal Name |
|---|---|---|---|
| 0 | EMUINT | MPU Subsystem Internal | Emulation interrupt (EMUICINTR) |
| 1 | COMMTX | MPU Subsystem Internal | CortexA8 COMMTX |
| 2 | COMMRX | MPU Subsystem Internal | CortexA8 COMMRX |
| 3 | BENCH | MPU Subsystem Internal | CortexA8 NPMUIRQ |
| 4 | ELM_IRQ | ELM | Sinterrupt (Error location process completion) |
| 5 | SSM_WFI_IRQ | MPU Subsystem Internal (SSM) | MPU s/s Secure State Machine Wait for Interrupt (WFI) tracking mechanism |
| 5 | Reserved | | |
| 6 | SSM_IRQ | MPU Subsystem Internal (SSM) | MPU s/s Secure State Machine interrupt generation for Public FIQ support |
| 6 | Reserved | | |
| 7 | NMI | External Pin (active low) | nmi_int |
| 8 | SEC_EVNT | Firewalls | security_events_irq |
| 8 | Reserved | | |
| 9 | L3DEBUG | L3 | l3_FlagMux_top_FlagOut1 |
| 10 | L3APPINT | L3 | l3_FlagMux_top_FlagOut0 |
| 11 | PRCMINT | PRCM | irq_mpu |
| 12 | EDMACOMPINT | TPCC (EDMA) | tpcc_int_pend_po0 |
| 13 | EDMAMPERR | TPCC (EDMA) | tpcc_mpint_pend_po |
| 14 | EDMAERRINT | TPCC (EDMA) | tpcc_errint_pend_po |
| 15 | WDT0INT | WDTIMER0 | PO_INT_PEND |

FIG.7A

58

| | | | |
|---|---|---|---|
| 15 | Reserved | | |
| 16 | ADC_TSC_GENINT | ADC_TSC (Touchscreen Controller) | gen_intr_pend |
| 17 | USBSSINT | USBSS | usbss_intr_pend |
| 18 | USBINT0 | USBSS | usb0_intr_pend |
| 19 | USBINT1 | USBSS | usb1_intr_pend |
| 20 | PRU_ICSS_EVTOUT0 | pr1_host[0] output/events exported from PRU-ICSS | pr1_host_intr0_intr_pend |
| 21 | PRU_ICSS_EVTOUT1 | pr1_host[1] output/events exported from PRU-ICSS | pr1_host_intr1_intr_pend |
| 22 | PRU_ICSS_EVTOUT2 | pr1_host[2] output/events exported from PRU-ICSS | pr1_host_intr2_intr_pend |
| 23 | PRU_ICSS_EVTOUT3 | pr1_host[3] output/events exported from PRU-ICSS | pr1_host_intr3_intr_pend |
| 24 | PRU_ICSS_EVTOUT4 | pr1_host[4] output/events exported from PRU-ICSS | pr1_host_intr4_intr_pend |
| 25 | PRU_ICSS_EVTOUT5 | pr1_host[5] output/events exported from PRU-ICSS | pr1_host_intr5_intr_pend |
| 26 | PRU_ICSS_EVTOUT6 | pr1_host[6] output/events exported from PRU-ICSS | pr1_host_intr6_intr_pend |
| 27 | PRU_ICSS_EVTOUT7 | pr1_host[7] output/events exported from PRU-ICSS | pr1_host_intr7_intr_pend |
| 28 | MMCSD1INT | MMCSD1 | SINTERRUPTN |

58-23 58-24 58-25

FIG.7B 50 52

| Start Address | PRU0 | PRU1 |
|---|---|---|
| 0x0000_0000 | Data 8KB RAM 0 | Data 8KB RAM 1 |
| 0x0000_2000 | Data 8KB RAM 1 | Data 8KB RAM 0 |
| 0x0001_0000 | Shared Data 12KB RAM 2 | Shared Data 12KB RAM 2 |
| 0x0002_0000 | INTC | INTC |
| 0x0002_2000 | PRU0 Control | PRU0 Control |
| 0x0002_2400 | Reserved | Reserved |
| 0x0002_4000 | PRU1 Control | PRU1 Control |
| 0x0002_4400 | Reserved | Reserved |
| 0x0002_6000 | CFG | CFG |
| 0x0002_8000 | UART 0 | UART 0 |
| 0x0002_A000 | Reserved | Reserved |
| 0x0002_C000 | Reserved | Reserved |
| 0x0002_E000 | IEP | IEP |
| 0x0003_0000 | eCAP 0 | eCAP 0 |
| 0x0003_2000 | MII_RT_CFG | MII_RT_CFG |
| 0x0003_2400 | MII_MDIO | MII_MDIO |
| 0x0003_4000 | Reserved | Reserved |

FIG. 8

ELECTRO-OPTICAL INFRARED (EOIR) SENSOR INTERFACE AND PROCESSING ON A PROGRAMMABLE REAL TIME UNIT (PRU)

TECHNICAL FIELD

The present disclosure relates to a guidance system for munition or rocket.

BACKGROUND

A guidance system for a munition or rocket is a highly accurate and versatile guided rocket designed to enhance the effectiveness of air-to-ground engagements. One non-limiting and exemplary guidance system is the Advanced Precision Kill Weapon System (APKWS) is offered by BAE Systems, Inc. These guidance systems may be used by military aircraft, helicopters, and unmanned aerial vehicles (UAVs), however civilian applications may be possible. These guidance systems, such as APKWS, combines the simplicity and low cost of unguided rockets with the precision of guided munitions, making it a valuable tool in modern warfare.

This type of munition guidance system has some of the following capabilities including, precision guidance, versatile warhead options, low collateral damage, compatibility, and cost effectiveness. With respect to precision guidance, this type of guidance system incorporates laser guidance technology, allowing it to engage targets with exceptional accuracy. It employs semi-active laser guidance, which means that a laser designator or targeting pod illuminates the target, and the rocket homes in on the reflected laser energy. With respect to versatile warhead options, this type of guidance system for a rocket or missile can be equipped with various warhead options, including high-explosive, blast-fragmentation, and even armor-piercing. This versatility enables it to engage a wide range of targets, including light vehicles, buildings, bunkers, and personnel. With respect to low collateral damage, this type of guidance system has the ability to minimize collateral damage. The precision guidance system allows for precise engagement, reducing the risk of unintended casualties and damage to nearby structures. With respect to compatibility, this type of guidance system is designed to be compatible with a range of aircraft and platforms, including fixed-wing aircraft such as fighter jets and attack aircraft, helicopters, and UAVs. It can be easily integrated into existing weapon systems, enabling armed forces to upgrade their capabilities without significant modifications. With respect to cost-effectiveness, this type of guidance system is a cost-effective solution for precision strikes. By utilizing existing unguided rockets, it significantly reduces the cost per weapon compared to more complex guided munitions. This makes it a viable option for both large-scale operations and more cost-constrained scenarios.

This type of guidance system can be beneficially utilized to provide close air support in missions where troops on the ground require precise and rapid engagement of targets in close proximity. Its accuracy and low collateral damage make it suitable for engaging targets near friendly forces. In counterinsurgency operations, where the identification and engagement of specific targets are crucial, this type of guidance system provides a precise and efficient solution. It can be used to engage enemy combatants, hideouts, vehicles, and other critical targets with minimal risk to civilians or infrastructure. Additionally, the precision and low collateral damage capabilities of this type of guidance system make it well-suited for urban warfare scenarios. It allows operators to engage targets in densely populated areas without risking civilian lives or damaging vital infrastructure.

SUMMARY

Although current guidance system implementations are beneficial, there is still room for improvement. For example, as threats become more advanced, there exists a need to upgrade or provide additional sensors or detectors on or in communication with this type of guidance system. The present disclosure addresses this need by providing embodiments, assemblies, systems or sub-systems and methods thereof that enhance this type of guidance system through the addition of other sensors or detectors, as well as the interfaces and programming that accomplish that addition. For example, the present disclosure enables the addition of an EO/IR sensor on a guided munition and interoperable with this type of guidance system. The present disclosure provides an interface that accounts for the additional overhead or processing required to utilize an EO/IR sensor with this type of guidance system of the guided munition.

In one aspect, an exemplary embodiment of the present disclosure may provide a guidance computer assembly (GCA) for a guided munition, the GCA comprising a Programmable Real-Time Unit Industrial Communication Sub-System (PRU-ICSS) comprising a first Programmable Real-Time Unit (PRU) and a second PRU; wherein the first PRU is programmed to receive and process input data from a first sensor on the guided munition; and wherein the second PRU is programmed to receive and process input data from a second sensor on the guided munition, wherein the second sensor is an EO/IR sensor on the guided munition. This exemplary embodiment or another exemplary embodiment may further include a set of General-Purpose Input/Output (GPIO) pins in at least the second PRU. This exemplary embodiment or another exemplary embodiment may further provide that at least one pin from the GPIO pins in the at least the second PRU is programmed as a Universal Asynchronous Receiver-Transmitter (UART) receiver. This exemplary embodiment or another exemplary embodiment may further provide that the second PRU communicates via Universal Asynchronous Receiver-Transmitter (UART) communications with the EO/IR sensor on the guided munition. This exemplary embodiment or another exemplary embodiment may further provide that the second PRU comprises a UART module in operative communication with the EO/IR sensor on the guided munition. This exemplary embodiment or another exemplary embodiment may further provide that the second PRU includes interrupts to handle signal reception from the EO/IR sensor on the guided munition. This exemplary embodiment or another exemplary embodiment may further include unused interrupts in the second PRU, wherein the interrupt to handle signal reception from the EO/IR sensor on the guided munition is between two adjacent unused interrupts that is adapted to reduce confliction. This exemplary embodiment or another exemplary embodiment may further include a memory map for the second PRU that triggers interrupts for the EO/IR sensor data according to memory map.

In another aspect, another exemplary embodiment of the present disclosure may provide a guidance system for a guided munition, the guidance system comprising: an inertial measurement unit (IMU) on the guided munition; an EO/IR sensor on the guided munition; and a GCA having a PRU-ICSS, wherein the PRU-ICSS is in operative communication with the IMU and the EO/IR. This exemplary embodiment or another exemplary embodiment may further include seeker electronics on the guided munition; and a control actuator system on the guided munition. This exemplary embodiment or another exemplary embodiment may further include a first PRU, wherein the first PRU is programmed to receive and process input data from the IMU on the guided munition, and a second PRU, wherein the second PRU is programmed to receive and process input data from the EO/IR sensor on the guided munition. This exemplary embodiment or another exemplary embodiment may further include a set of GPIO, wherein at least one pin from the set of GPIO pins is programmed as a UART receiver in operative communication with the EO/IR sensor on the guided munition. This exemplary embodiment or another exemplary embodiment may further provide that the second PRU comprises a UART module in operative communication with the EO/IR sensor on the guided munition; and at least one interrupt to handle signal reception from the EO/IR sensor on the guided munition into the second PRU. This exemplary embodiment or another exemplary embodiment may further provide that the second PRU comprises a memory map for the second PRU that triggers interrupts for the EO/IR sensor data according to memory map.

In another aspect, another exemplary embodiment of the present disclosure may provide a method comprising: providing a guidance system for a guided munition, the guidance system including a GCA having a PRU-ICSS including at least one PRU; and interfacing an EO/IR sensor on the guided munition with the at least one PRU. This exemplary method embodiment or another exemplary method embodiment may further include configuring at least one pin from a set of GPIO pins on the at least one PRU as a UART receiver; connecting the pin configured as the UART receiver with the EO/IR sensor; and effecting transmission of signals between the EO/IR sensor and the pin configured as the UART receiver. This exemplary method embodiment or another exemplary method embodiment may further include effecting pulsed signals to be received by the at least one PRU from the EO/IR. This exemplary method embodiment or another exemplary method embodiment may further include effecting transmission of signals from the pin configured as the UART receiver to a system interrupt controller that is part of the GCA. This exemplary method embodiment or another exemplary method embodiment may further include effecting, via the system interrupt controller, interruption of other signals in the GCA in response to the signals received from the pin configured as the UART receiver. This exemplary method embodiment or another exemplary method embodiment may further include effecting the signals received from the pin configured as the UART receiver to be placed into a shared memory address, wherein the shared memory address is shared and used by the at least two PRUs, wherein the at least one PRU is one of the at least two PRUs.

In yet another aspect, an exemplary embodiment of the present disclosure may provide a guided munition comprising: a thrust system near a tail end; explosive material configured to detonate at or near an intended target; an IMU; an EO/IR sensor; and a GCA having a PRU-ICSS, wherein the PRU-ICSS is in operative communication with the IMU and the EO/IR.

BRIEF DESCRIPTION OF THE SEVERAL VIEWS OF THE DRAWINGS

Sample embodiments of the present disclosure are set forth in the following description, are shown in the drawings and are particularly and distinctly pointed out and set forth in the appended claims.

FIG. 4 (FIG. 4) is a table depicting pin configuration modes for one of the Programmable Real-Time Units to operate or be configured as a UART receiver of EO/IR data from a EO/IR sensor on the guided munition.

FIG. 7A (FIG. 7A) is a first portion of a table of processor interrupts that is to be read in conjunction with FIG. 7B.

FIG. 7B (FIG. 7B) is the second portion of the table of the processor interrupts that completes FIG. 7A, wherein the table of FIG. 7A and FIG. 7B are to be read together as a whole but are shown separated due to space constraints.

FIG. 8 (FIG. 8) is a table of a local memory map.

Similar numbers refer to similar parts throughout the drawings.

DETAILED DESCRIPTION

Figure 1A:
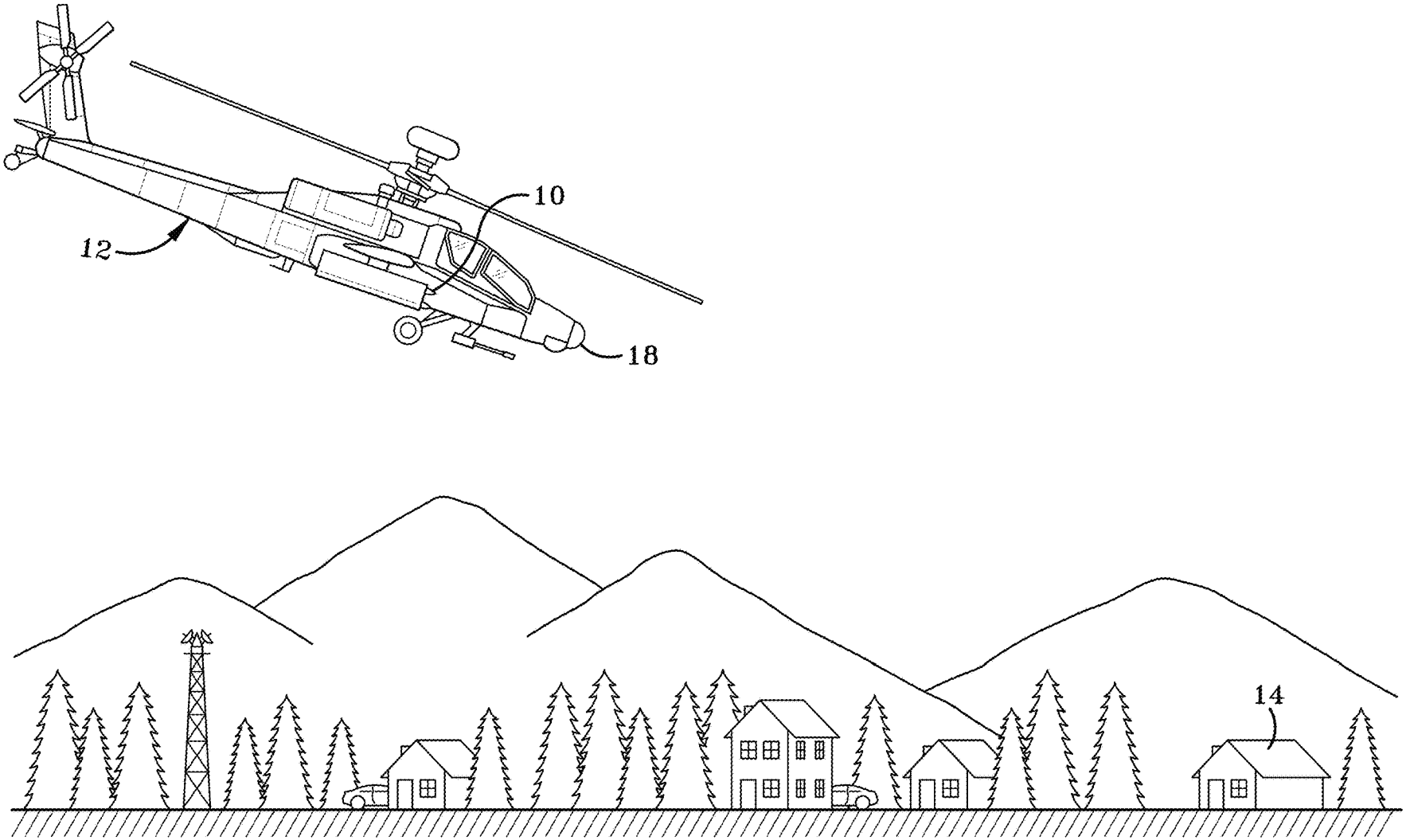
FIG. 1A (FIG. 1A) is a diagrammatic view of a precision guided munition system, carried by another platform, such as a helicopter.
Figure 1B:
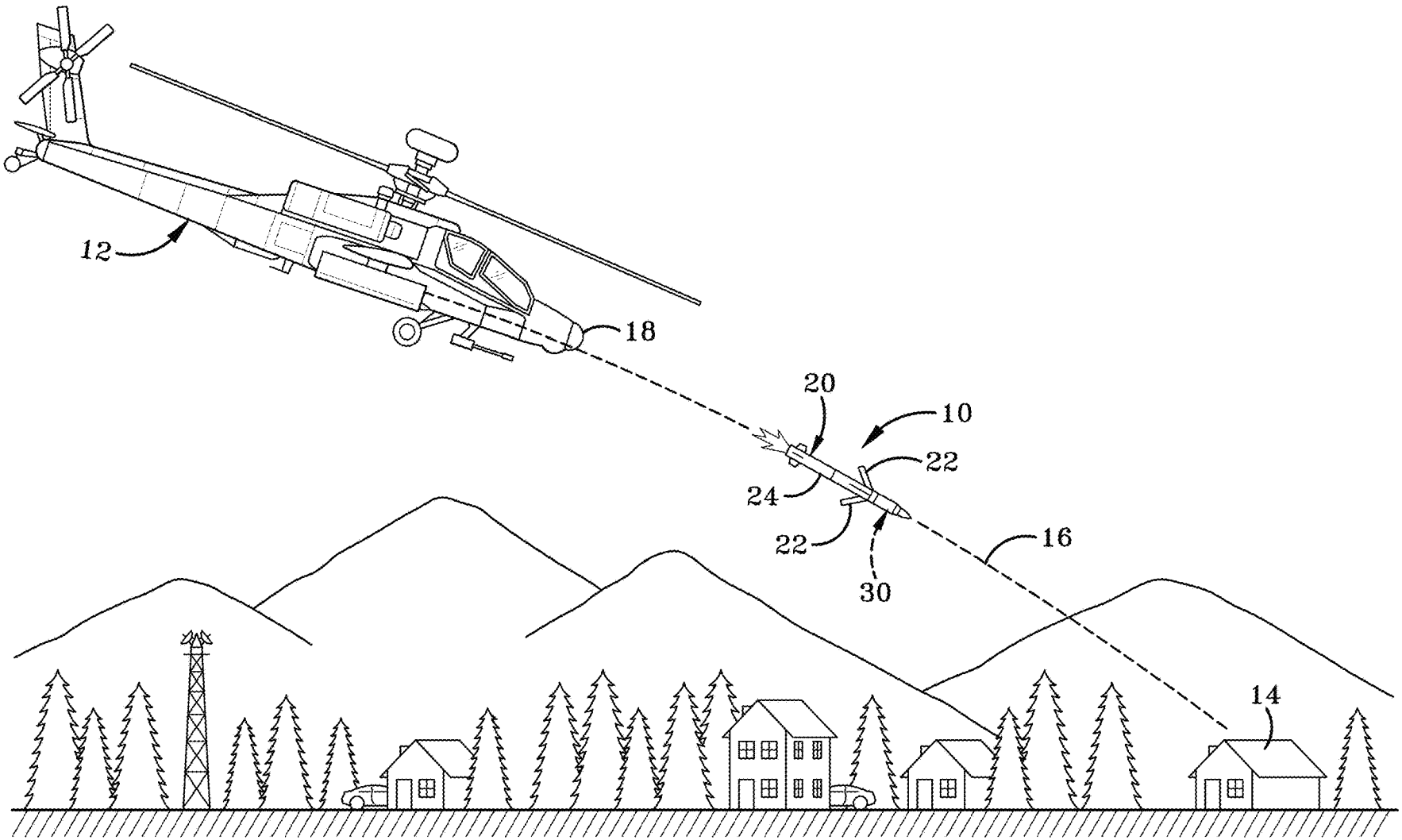
FIG. 1B (FIG. 1B) is a diagrammatic view of the precision guided munition having been launched, shot, or otherwise deployed, by the platform towards an intended target.

FIG. 1A and FIG. 1B depict an environment of an aerial vehicle or platform for a precision guided munition 10. The precision guided munition 10 is carried by the platform 12, which may also be referred to as aerial vehicle 12 such as a helicopter, airplane or drone. When platform 12 is embodied as an aerial vehicle, it may be either manned or unmanned. Alternatively, aerial vehicle 12 may be a jet aircraft. Alternatively, platform 12 can be a fixed installation, such as a launch assembly for a surface-to-air missile (SAM). Platform 12 is configured to launch or fire the precision guided munition 10 towards an intended target 14 along a trajectory 16. The platform 12 in one embodiment has a laser designator system 18. In another embodiment a laser designator system can be ground based or on a different aerial vehicle. Alternatively, the laser designator system can be on the munition 10.

The precision guided munition 10, in one example, may be an APKWS precision guided rocket having a Distributed Aperture Semi-Active Laser Seeker (DASALS) technology (or alternatively Distributed Array summation technology) and a thrust system located near the tail of the munition 10. In other embodiments, the munition 10 may be any other type of guided munition.

The guided munition 10 may optionally include at least one canard or wing 22 mechanically connected to the main body or fuselage 24 of the precision guided munition 10. Within the main body or fuselage 24, the precision guided munition 10 may house munitions or other explosive materials, which are configured to detonate on impact or near impact at the intended target 14. As one having ordinary skill in the art understands, the laser system 18 in one example is configured to guide the precision guided munition 10 towards the intended target 14. At least one wing 22, which may be one of four wings connected to the body 24, may be configured to deploy from a collapsed first position to a deployed second position. The wings 22 may optionally be steerable or moveable to steer the munition 10.

Figure 2:
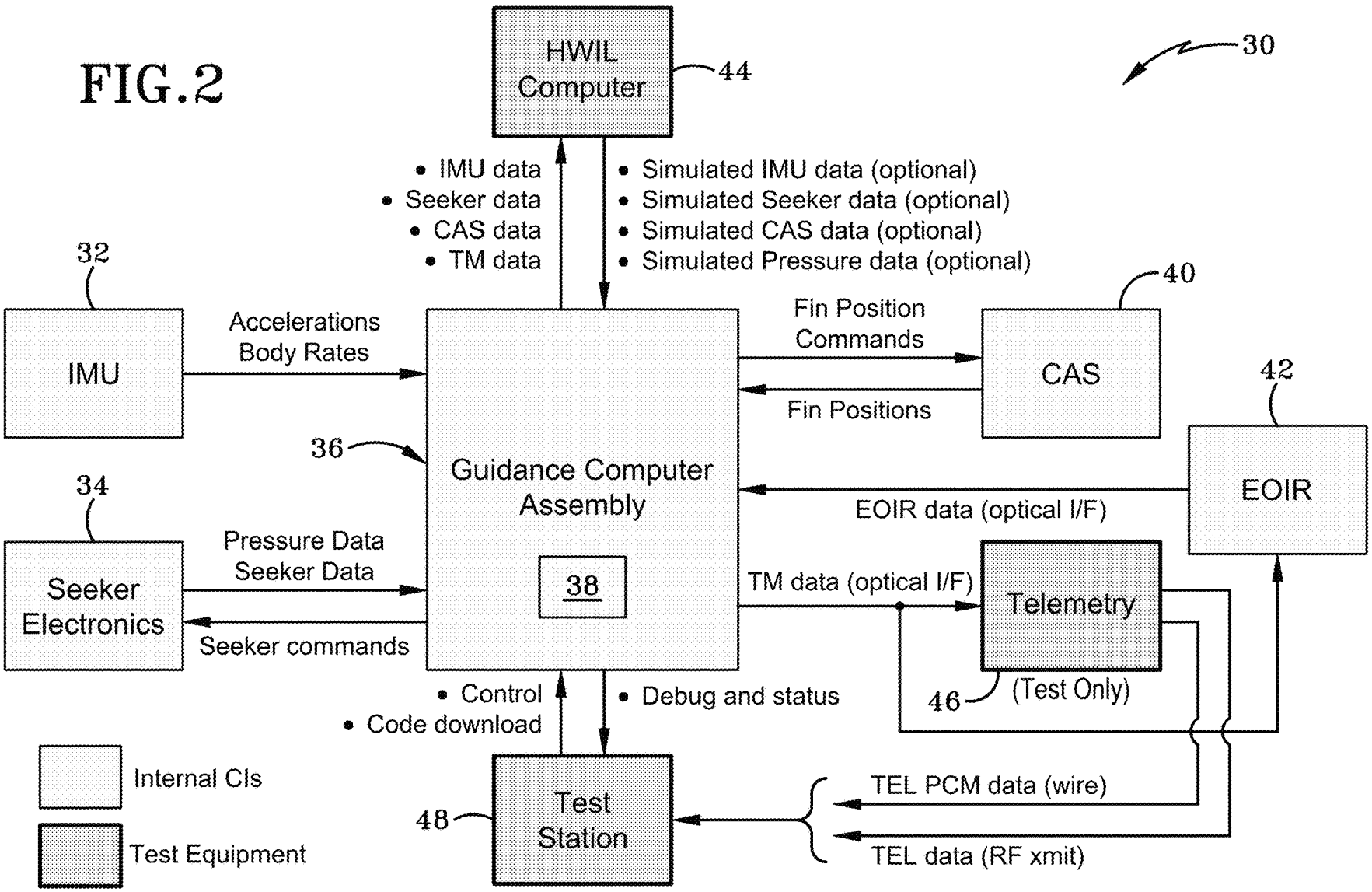
FIG. 2 (FIG. 2) is a schematic view of guidance system on the munition that incorporates an EO/IR sensor according to one aspect of the present disclosure.

FIG. 1B and FIG. 2 depict that the guided munition 10 may include a guidance system 30. Guidance system 30 may include a first sensor 32, which may be an inertial measurement unit (IMU) 32 or another type of sensor, seeker electronics 34, a guidance computer assembly (GCA) 36 having a Programmable Real-Time Unit Industrial Communication SubSystem (PRU-ICSS) 38, a control actuator system (CAS) 40. There may be a second sensor 42 on munition 10, and the second sensor 42 may be at least one electro-optical/infrared (EO/IR) sensor 42. The guidance system 30 may also include a variety of test equipment, such as hardware-in-the-loop (HWIL) computer 44, a telemetry assembly 46, and a test station 48.

The guidance system 30 of the guided munition 10 includes the IMU 32 or another type of first sensor to provide navigation and guidance capabilities. The IMU 32 is a sensor package that measures and tracks the munition's 10 motion and orientation in three-dimensional space. The IMU 32 incorporates multiple accelerometers, which are sensitive devices that measure acceleration along the three orthogonal axes: X, Y, and Z. These accelerometers detect changes in velocity and acceleration, allowing the IMU 32 to determine the munition's linear motion in all directions. The IMU 32 may include gyroscopes, which are rotational rate sensors. They measure angular velocity and provide information about the munition's rotational motion around the three axes. By integrating the gyroscopic measurements over time, the IMU 32 determines the munition's orientation and angular displacement. To detect the Earth's magnetic field, the IMU 32 may optionally utilize magnetometers. These sensors provide information about the munition's heading or orientation with respect to the Earth's magnetic field. By combining the magnetometer data with other sensor measurements, the IMU 32 can compensate for magnetic interference and improve the accuracy of its orientation estimation. The IMU 32 may utilize algorithms for sensor fusion and filtering. It combines the measurements from the accelerometers, gyroscopes, and magnetometers to calculate the munition's precise position, velocity, and orientation. Advanced filtering techniques, such as Kalman filters, may be used to optimize the accuracy and stability of the derived motion and orientation estimates. To ensure accurate measurements, the IMU 32 may undergo calibration procedures to eliminate bias, scale factor errors, and cross-axis sensitivity. Additionally, temperature compensation algorithms are employed to account for variations in sensor performance due to temperature changes experienced during flight. The data from the IMU 32 may be utilized in the munition's navigation and guidance system to determine its current position, velocity, and orientation. By integrating the IMU 32 measurements with other inputs, such as GPS data or laser guidance, the guidance system can compute the optimal flight path, adjust for deviations, and steer the munition towards its intended target. The IMU 32 can continuously provide real-time updates of the munition's motion and orientation, enabling the guidance system to make rapid adjustments and corrections to maintain precise flight trajectory and ensure accurate target engagement.

In addition to the IMU 32, there may also be an inertial navigation system (INS), which may also be considered generally to be the first sensor on the munition 10. The IMU and the INS are closely integrated components in the guided munition, working together to provide accurate and reliable navigation capabilities. The IMU's raw sensor measurements are processed through sensor fusion algorithms, typically implemented using Kalman filtering or other estimation techniques. These algorithms combine the accelerometer, gyroscope, and magnetometer data to estimate the munition's position, velocity, and attitude (orientation) accurately. During the guided munition's initialization phase, the INS incorporates the IMU measurements to establish an initial estimate of the munition's position, velocity, and attitude. This initialization process is typically referred to as alignment or initialization alignment. Once the INS is initialized, it integrates the IMU measurements over time using mathematical integration techniques. By continuously updating the position, velocity, and attitude estimates based on the IMU data, the INS provides a dynamically evolving navigation solution. The INS may constantly monitor the IMU measurements for errors and drift that may accumulate over time due to sensor imperfections or external disturbances. Calibration techniques, such as bias compensation and scale factor correction, may be applied to minimize these errors and maintain the accuracy of the navigation solution. In addition to the IMU measurements, the INS can incorporate external inputs to enhance the navigation accuracy. For example, the INS can receive Global Positioning System (GPS), which may also generally be considered to be the first sensor on the munition 10, updates or utilize data from other external sensors, such as altimeters or airspeed sensors. These additional inputs can help compensate for any drift or errors that may occur in the IMU over extended durations. The INS, with the integration of IMU data and potential external inputs, may provide a continuous navigation solution, including the munition's position, velocity, and attitude. This information is critical for guiding the munition along its intended trajectory and enabling accurate target engagement.

The IMU 32 is in operative electrical communication with the GCA 36 via a transmission line. The transmission line enables the IMU 32 to exchange data or signals with the GCA 36. In one particular embodiment, accelerations and/or body rates are transmitted along the transmission line between the IMU 32 and the GCA 36.

The seeker electronics 34 on the guided munition 10 are responsible for acquiring and processing information from various sensors to track and locate the target 14. Seeker electronics 34 play a role in the guidance and targeting system of the munition 10. While the specific components can vary depending on the munition's design and technology, the following non-exhaustive list includes components that may be part of the seeker electronics 34: IR seekers, laser seekers, and radar seekers. An IR seeker may be designed for heat-seeking or infrared homing. The IR seeker detects and tracks the target based on its thermal signature. Seeker data from the IR seeker includes target position, velocity, and intensity, allowing the munition to maintain lock on the target. Laser seekers use laser energy to detect and track the target. They emit laser beams and measure the reflected energy to determine the target's range, position, and velocity. Seeker data from the laser seeker includes target range, angular position, and target signature information. Some guided munitions 10 may incorporate radar seekers, especially in anti-aircraft or anti-missile systems. Radar seekers use radio waves to detect and track targets. They provide seeker data such as target range, velocity, and angle of approach. Pressure data may also be used in some radar seeker designs to compensate for atmospheric effects on radar performance. The seeker data processing unit is responsible for receiving, processing, and analyzing the seeker data from various sensors. It includes signal processing algorithms, target tracking algorithms, and fusion algorithms to combine and interpret the seeker data for accurate target tracking and guidance. Pressure sensors may be integrated into the seeker electronics 34 to measure air pressure or dynamic pressure during the munition's flight. Pressure data is used for altitude estimation, airspeed compensation, or to compensate for environmental factors that may affect the munition's trajectory.

The seeker electronics 34 are in operative electrical communication with the GCA 36 via a transmission line. Towards this end, the seeker electronics may also generally be considered the first sensor connected to the GCA on the munition 10. The transmission line enables the seeker electronics 34 to exchange data or signals with the GCA 36. In one particular embodiment, pressure data, seeker data, and/or seeker commands, are transmitted along the transmission line between the seeker electronics 34 and the GCA 36.

Within the GCA 36 is the PRU-ICSS 38. One exemplary PRU-ICSS 38 is supplied by Texas Instruments. The PRU-ICSS 38 is a highly integrated subsystem that combines a dual-core microcontroller (MCU) with dedicated hardware for real-time communication and automation applications.

In some implementations, the PRU-ICSS 38 is part of the GCA 36 of the APKWS or munition 10 to provide real-time control and communication capabilities. The PRU-ICSS 38 can be programmed to handle real-time control tasks within the GCA 36. The PRU-ICSS 38 can execute control algorithms, process sensor data, and generate precise control signals for the APKWS or guidance system 30. By offloading these time-critical tasks to the PRU-ICSS 38, the main processor is freed up to handle higher-level functions and overall system management. The PRU-ICSS 38 can be connected to various sensors within the APKWS or guidance system 30, such as accelerometers, gyroscopes, and altitude sensors. The PRU-ICSS 38 can capture and process the sensor data in real-time, providing essential inputs for the guidance algorithms. The PRU-ICSS 38 can interface with these sensors via General-Purpose Input/Output (GPIO) pins or dedicated sensor interfaces, depending on the system design. The PRU-ICSS 38 can facilitate communication within the GCA 36 and with other components of the APKWS or guidance system 30. The PRU-ICSS 38 can handle low-latency communication protocols, such as inter-processor communication (IPC) with the main processor or direct communication with other subsystems. This enables efficient data exchange and coordination between different components of the guidance system 30. The PRU-ICSS 38 can execute time-critical tasks required for the APKWS or guidance system 30, such as trajectory calculations, guidance algorithms, and control signal generation. Its deterministic and low-latency performance ensures accurate and timely execution of these tasks, contributing to the precision and effectiveness of the weapon system. The PRU-ICSS 38 can be seamlessly integrated into the overall GCA 36 architecture of the APKWS or guidance system 30. Its flexible programmability allows system 30 to adapt the PRU-ICSS 38 to the specific requirements of the guidance system, ensuring efficient coordination and functionality within the overall weapon system design.

Figure 3:
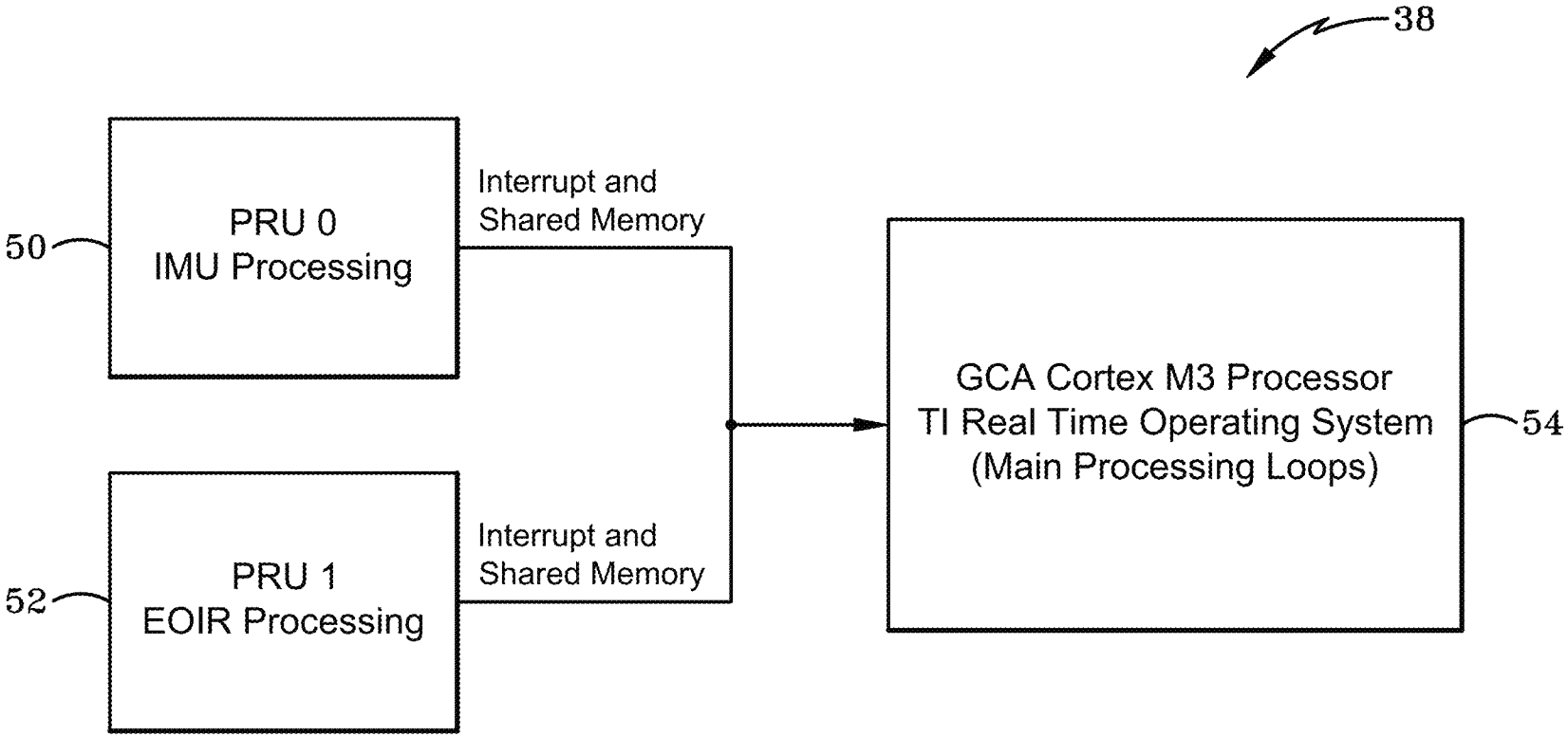
FIG. 3 (FIG. 3) is a schematic view of the Programmable Real-Time Unit Industrial Communication SubSystem having two Programmable Real-Time Units and a main processor.

FIG. 2 and FIG. 3 depict that the PRU-ICSS 38 includes two Programmable Real-Time Units (PRUs) (i.e., a first PRU 50 and a second PRU 52) that are designed to operate in parallel with the main ARM Cortex-A series processor 54. In one embodiment, each PRU 50, 52 in the PRU-ICSS 38 may be a 32-bit Reduced Instruction Set Computer (RISC) microcontroller, capable of running at high speeds with deterministic, real-time performance. However other bit rate microcontrollers are possible. Each PRU 50, 52 may be a standalone 32-bit RISC microcontroller. The PRUs 50, 52 may be optimized for performing embedded tasks that require manipulation of packed memory data structures, handling of system events that have tight real-time constraints and interfacing with systems external to the System on Chip (SOC). These PRUs 50, 52 provide real-time processing capabilities, allowing system 30 to offload time-critical tasks and achieve deterministic, low-latency execution. The PRU-ICSS 38 provides dedicated real-time processing capabilities, enabling fast and deterministic execution of control algorithms and time-critical tasks. The PRUs 50, 52 can execute instructions at high speeds and respond to events with minimal latency, making them advantageous for real-time applications. The PRU-ICSS 38 allows developers to write software for the PRUs using a high-level language, such as C or assembly, and integrate it with the main processor's 54 software stack. This flexibility enables system 30 to offload time-critical tasks from the main processor 54, freeing up its resources for other processing needs. The PRU-ICSS 38 includes specialized hardware and firmware for implementing various communication protocols. This makes it well-suited for applications in automation and control systems, where reliable and efficient communication is essential. The PRU-ICSS 38 includes a set of GPIO pins and Pulse-Width Modulation (PWM) outputs. The PRU-ICSS 38 supports communication between the PRUs 50, 52 and the main ARM Cortex-A series processor 54, enabling seamless data exchange and coordination between the two processing domains. This allows system 30 to leverage the strengths of both the main processor 54 and the PRUs 50, 52. The PRUs 50, 52 may also be referred to as the cores, or each individually a core, of the PRU-ICSS 38.

The PRUs 50, 52 can utilize Universal Asynchronous Receiver-Transmitter (UART) communications for data exchange with external devices. In one particular embodiment, the second PRU 52 communicates with the EO/IR sensor 42 via UART communications. UART is a serial communication protocol that allows for asynchronous, byte-oriented data transmission. It comprises two main components: a transmitter (UART TX) and a receiver (UART RX). The PRUs can be configured to interface with UART devices, such as EO/IR sensor 42, by utilizing the UART modules available in the PRU-ICSS 38. Each PRU 50, 52 can be programmed to configure its UART module according to the desired bit rate, bandwidth, baud rate, data format, or other parameters specific to the external UART device, such as that of the EO/IR sensor 42. This configuration typically involves setting the UART control registers, such as the baud rate divisor, data format (e.g., data bits, parity, stop bits), and flow control settings to match that of the external device, such as the EO/IR sensor 42. The PRU can transmit data over UART by writing the data to a UART transmit buffer. The data is then transmitted bit by bit according to the configured parameters, including the specified bit rate, bandwidth or baud rate of the EO/IR sensor 42. The UART module handles the serialization and transmission of the data as a continuous stream of bits. The PRU can receive data over UART by reading from a UART receive buffer. As data arrives from the EO/IR sensor 42, the UART module receives and converts it back into bytes according to the configured parameters. The PRU can periodically check the receive buffer or be interrupted by the UART module to read the received data. The PRU can utilize UART interrupts or polling to handle data transmission and reception. UART interrupts allow the PRU to be notified when new data is available in the receive buffer or when the transmit buffer is ready for more data. Polling involves periodically checking the UART status registers to determine the availability of new data or the readiness of the transmit buffer. The PRUs can communicate with external devices such as sensors, actuators, or other microcontrollers that support UART communications. By connecting the UART transmit and receive lines or pins of the PRU to the corresponding lines of the external device, such as EO/IR sensor 42, data can be exchanged between the PRU and the external device.

In at least one of the PRUs, or both PRUs 50, 52, there is an Advanced RISC Machine (ARM) interrupt mechanism that allows for communication and synchronization between the PRUs 50, 52 and the main ARM processor 54 within the GCA 36. It enables the PRU to notify the ARM processor 54 of specific events or trigger actions in the ARM's execution flow. In one particular embodiment, the communication of the second PRU 52 with the EO/IR sensor 42 trigger actions in the ARM's execution flow. The PRU may generate an interrupt request to the ARM processor when a specific condition or event occurs. This condition could be the completion of a task of the EO/IR sensor 42, the occurrence of an external event detected by the EO/IR sensor 42, or a specific status flag being set within the PRU. The PRU is equipped with an interrupt controller that manages the generation and routing of interrupts. It includes registers and control logic to handle interrupts. The PRU can configure the interrupt controller to enable or disable specific interrupt sources and set their priorities. When the PRU generates an interrupt request, it asserts the corresponding interrupt signal to the interrupt controller of the ARM processor. The interrupt signal is typically a specific GPIO pin dedicated to interrupt signaling between the PRU and ARM. Then, the ARM processor 54 has its own interrupt controller, which receives and manages interrupt signals from various sources, including the PRU. The interrupt controller prioritizes and handles the interrupts based on their priorities and the ARM's current execution context. When the ARM interrupt controller receives the interrupt signal from the PRU, it suspends the current execution of the ARM processor 54 and handles the interrupt. The ARM processor 54 typically saves the current context, including the program counter and other registers, before executing an interrupt service routine (ISR) specific to the PRU interrupt. The ISR is a piece of code that executes in response to the PRU interrupt. It can be predefined in the ARM software stack and is responsible for handling the interrupt event. The ISR may perform tasks such as reading data from the PRU, acknowledging the interrupt, updating shared memory, or triggering further actions in the system. Once the ISR completes its execution, the ARM processor restores the saved context, including the program counter and registers, and resumes its previous execution state. Thus, the PRU to ARM interrupt mechanism facilitates communication and synchronization between the PRUs and the ARM processor, allowing for real-time event-driven interactions. It enables the PRUs to notify the ARM processor of critical events or trigger actions in the ARM's execution flow, making it advantageous for coordination and control in real-time for guidance system 30.

FIG. 2 depicts that the CAS 40 in the guidance system 30 is responsible for controlling the movement and positioning of the munition's 10 control surfaces, typically fins, canards or wings 22, during flight. These control surfaces play a role in stabilizing and maneuvering the munition 10 to achieve the desired trajectory and accuracy. The CAS 40 includes actuators, which are devices responsible for moving the control surfaces. The actuators can be hydraulic, pneumatic, or electric, depending on the specific design of the guided munition. The CAS 40 receives control commands from the munition's guidance and control system. These commands are typically generated based on inputs from various sensors and guidance algorithms, which determine the desired trajectory and corrections needed during flight. Upon receiving the control commands, the actuators of the CAS 40 actuate the control surfaces accordingly. They generate the necessary forces and moments to move the control surfaces to the desired positions and orientations. As the control surfaces move, they create aerodynamic forces that act on the guided munition. By adjusting the angles or positions of the control surfaces, the CAS 40 can influence the aerodynamic forces acting on the munition, thus controlling its flight path and stability. The CAS 40 may incorporate feedback mechanisms to ensure accurate control. Sensors, such as gyroscopes or accelerometers, can provide feedback on the munition's actual orientation and motion, allowing the control actuator system to make adjustments and maintain the desired flight trajectory. During flight, the CAS 40 continuously adjusts the control surfaces based on real-time inputs and feedback, allowing the munition to respond to changing conditions or guidance commands. This dynamic control enables the munition to compensate for external disturbances, adjust its trajectory, and improve accuracy.

The CAS 40 is in operative electrical communication with the GCA 36 via a transmission line. The transmission line enables the CAS 40 to exchange data or signals with the GCA 36. In one particular embodiment, fin 22 position commands and fin 22 positions, are transmitted along the transmission line between the CAS 40 and the GCA 36.

With continued reference to FIG. 2, the guidance system 30 or assembly of the present disclosure also includes an electro-optical/infrared (EO/IR) sensor 42 on munition 10. The EO/IR sensor 42 is a device that is typically part of an imaging system supported by computing architectures. EO/IR systems enable situational awareness during both the day and at night, as well as in conditions with limited light. There may be at least two aspects of EO/IR sensors 42, namely, electro-optical and infrared. Electro-optical sensors can convert light into electric signals, whereas infrared sensors can detect any structure in its surroundings by either emitting or detecting infrared radiation. EO/IR sensors 42 are imaging systems that use both visible and infrared light to provide situational awareness, target identification, and threat assessment. EO/IR sensors 42 is able to detect electromagnetic radiation from the infrared up to the ultraviolet wavelengths.

EO/IR sensors 42 on guided munition 10 may be used for various purposes such as target acquisition, tracking, and guidance. EO/IR sensors 42 can detect and track targets 14 such as vehicles, aircraft, and personnel or any other threat from long distances. EO/IR sensors 42 can also be used to identify targets, such as target 14, by their heat signature or other characteristics. EO/IR sensors 42 can provide precise targeting information to weapons systems such as missiles or bombs. EO/IR sensors can also be used to jam or disrupt enemy communications systems. EO/IR sensors can also be used for surveillance and reconnaissance missions.

One exemplary GCA 36 of the present disclosure utilizes a dedicated GPIO pin in the PRU-ICSS 38 on one of the two PRUs, such as the second PRU 52, to couple with an EO/IR sensor 42 on the guided munition 10 or other platform. The EO/IR sensor 42 is in operative electrical communication with the GCA 36 and the PRU-ICSS 38 via a transmission line. The transmission line enables the EO/IR sensor 42 to exchange data or signals with at least one of the PRUs, such as second PRU 52. In one particular embodiment, EO/IR data and/or optical data are transmitted along the transmission line between the EO/IR sensor 42 and the second PRU 52 in PRU-ICSS 38. Further, the EO/IR sensor may receive telemetry data from the GCA 36 via another transmission line that splits the telemetry data sent from the GCA 36 to the telemetry assembly 46.

Guidance system 30 may also be provided with a variety of test equipment. Regarding some of the test equipment that may be part of the test equipment, the HWIL 44 is a simulation computer or HWIL test computer that is a specialized computer system used in the development, testing, and evaluation of complex systems, such as missiles, aircraft, or vehicles. The HWIL 44 computer serves as the centerpiece of a HWIL simulation, which aims to replicate real-world operating conditions by integrating actual hardware components with virtual or simulated elements. The purpose of HWIL 44 testing is to assess the performance, functionality, and interoperability of a system before it is deployed or used in real-world scenarios. The HWIL 44 computer interfaces with various hardware components, including sensors, actuators, control systems, and subsystems, to create a realistic simulation environment. It connects to these physical components and provides the necessary interfaces to control and monitor their behavior. The HWIL 44 computer executes sophisticated real-time simulation software that models the dynamics, physics, and behavior of the system being tested. This software generates the virtual environment and simulates the interactions of the system with its surroundings, such as atmospheric conditions, targets, or other external factors. The HWIL 44 computer collects data from the physical hardware components and the simulated environment in real-time. It processes this data, performs calculations, and provides feedback to the simulation software to update the system's state and response accordingly. In some cases, the HWIL 44 computer can emulate or simulate the behavior of sensors, such as radars, cameras or EO/IR sensors, or guidance systems, that are integral to the system being tested. This allows for comprehensive testing of the system's performance in different scenarios and under varying sensor conditions. The HWIL 44 computer generates control signals and commands that are sent to the system being tested. These commands simulate the inputs the system would receive in actual operation, allowing for evaluation of its response and performance under different scenarios and conditions. The HWIL 44 computer collects and analyzes data on system performance, including metrics such as accuracy, response time, stability, and reliability. This analysis helps identify areas for improvement, refine algorithms, and validate the system's overall performance against design specifications.

The HWIL 44 computer is in operative electrical communication with the GCA 36 via a transmission line. The transmission line enables the HWIL 44 computer to exchange data or signals with the GCA 36. In one particular embodiment, IMU data, seeker data, CAS data, and telemetry data, are transmitted along the transmission line between the HWIL 44 computer and the GCA 36.

The telemetry assembly 46 or telemetry test equipment enables the collection, transmission, and analysis of real-time data from the munition during its flight or other operational scenarios. The telemetry assembly 46 or telemetry test equipment is responsible for gathering data from various sensors and systems onboard the guided munition. This data can include information such as position, velocity, acceleration, attitude (orientation), temperature, pressure, and other relevant parameters. The equipment interfaces with the munition's sensors or internal systems to collect this data during the test or operational phase. Once collected, the telemetry assembly 46 or telemetry test equipment facilitates the transmission of the acquired data from the guided munition to a ground station or receiving system in real-time. This is typically achieved through wireless communication links, such as radio frequency (RF) or telemetry transmitters, which transmit the data to the receiving equipment located on the ground or a nearby aircraft. The receiving equipment on the ground or in a monitoring station captures the transmitted telemetry data. It may involve antennas, receivers, and data acquisition systems designed to receive and record the telemetry signals. The equipment processes the incoming data stream, demodulates it, and stores it for further analysis and evaluation. The telemetry assembly 46 or telemetry test equipment provides tools and software for analyzing the collected telemetry data. This analysis can involve extracting relevant information, identifying trends, assessing system performance, and comparing the measured data against expected or desired parameters. The analysis helps evaluate the performance, functionality, and reliability of the guided munition during the test or operational phase. The telemetry assembly 46 or telemetry test equipment allows for real-time monitoring of the guided munition's performance. It provides live data visualization, graphical displays, and alarms/alerts to ensure that the munition is operating within acceptable limits. Monitoring the telemetry data during testing provides valuable insights into the system's behavior and can help identify anomalies or issues that require further investigation. The telemetry assembly 46 or telemetry test equipment supports post-test evaluation by providing tools for comprehensive data review and analysis. An analysis can be performed to review the recorded telemetry data and compare the results against expected outcomes or simulations. This evaluation aids in identifying areas for improvement, optimizing performance, and refining the design or operational parameters of the guided munition.

FIG. 4 depicts a table identifying one exemplary pin multiplexing (Pinmux) scheme for a dedicated GPIO pin D16 on one of the two PRUs, such as the second PRU 52, to couple or interface with the EO/IR sensor 42 on the guided munition 10. The pin D16 may be placed or programmed into mode 5 to enable the pin D16 of second PRU 52 to operate as a UART receiver 56 or pr1_uart0_rxd. Software is added or programmed to at least one of the PRUs, such as second PRU 52, to handle the UART messages between the EO/IR sensor 42 and the second PRU 52.

Figure 5:
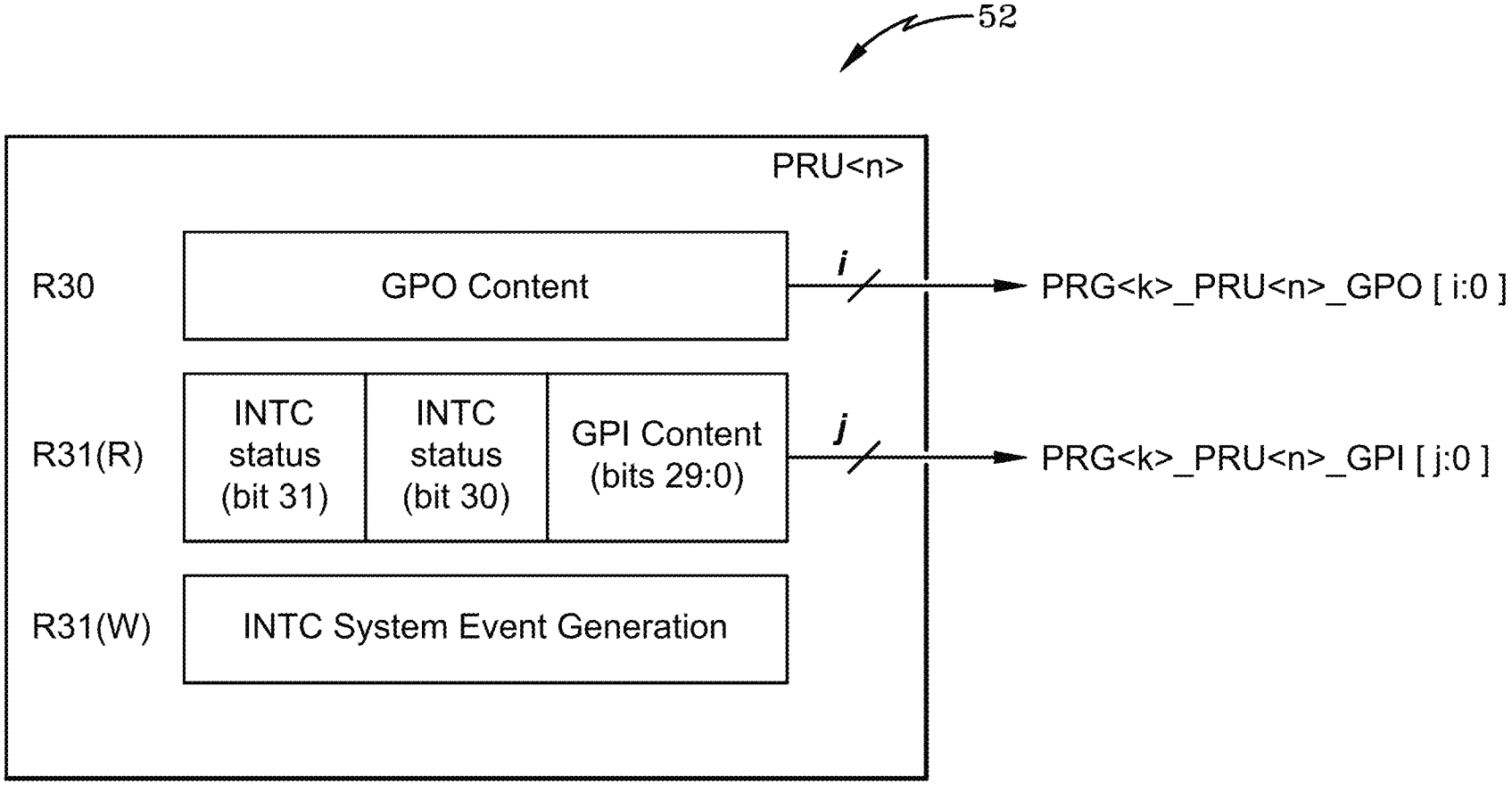
FIG. 5 (FIG. 5) is a schematic view of PRU module interface for one of the two PRUs.

FIG. 5 depicts the PRU event interface for second PRU 52. The PRU event interface directly feeds pulsed event information out of the PRU's internal arithmetic logic unit (ALU). These events are exported out of the PRU-ICSS 38 and are connected to the system interrupt controller of the GCA 36. The event interface is used by the firmware to create software interrupts from the second PRU 52 to the processor 54.

Figure 6:
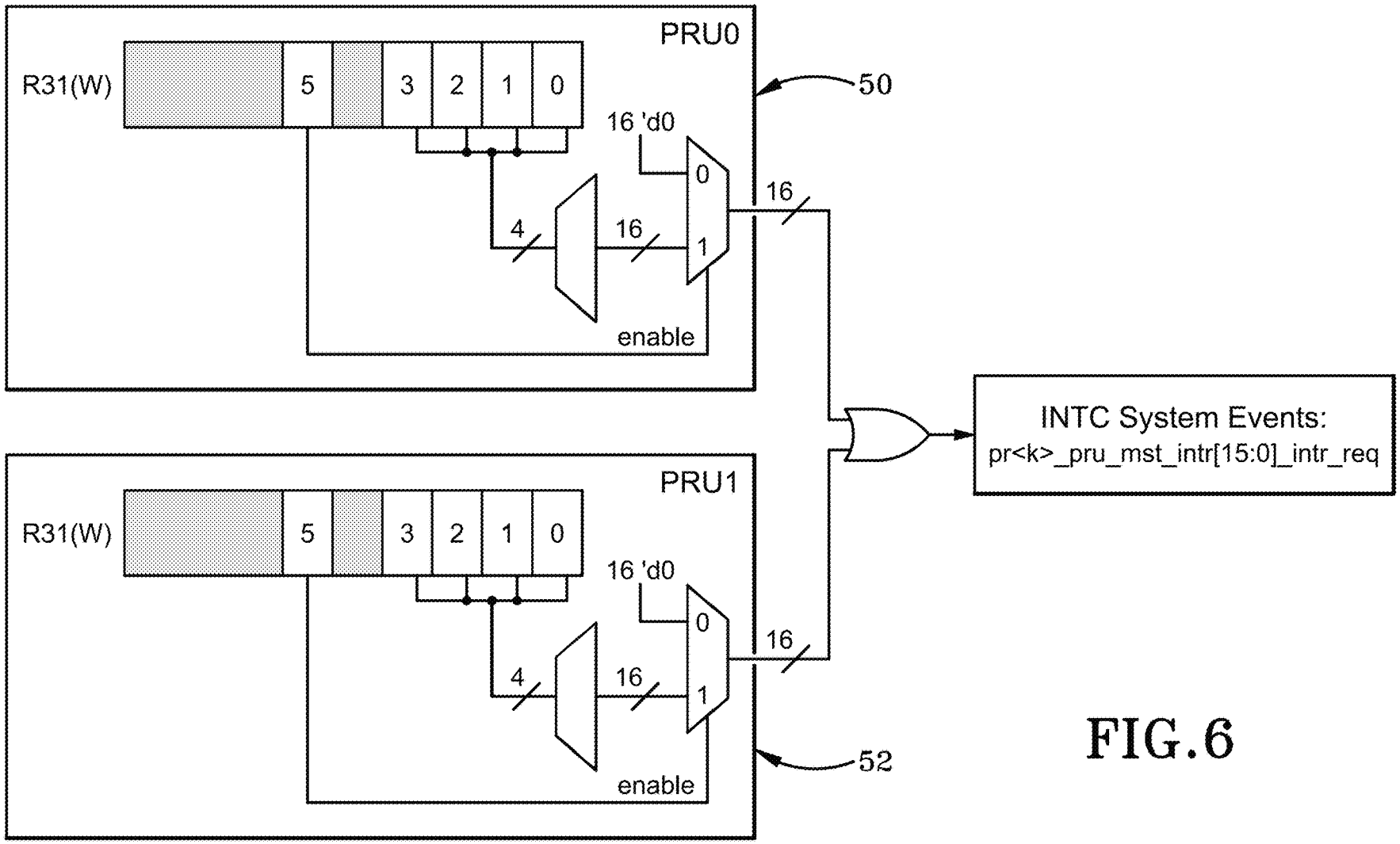
FIG. 6 (FIG. 6) is a schematic view of another event interface mapping for one of the two PRUs.

FIG. 6 depicts the multiplexing of interrupt registers. The interrupt registers are used in response to the second PRU 52 receiving messages or data signal from the EO/IR sensor 42. Before the received message or data data signal from the EO/IR sensor 42 is transferred to processor 54, the core of the PRU 52 is interrupted. The interrupt is configured as shown in FIG. 6.

FIG. 7A and FIG. 7B collectively depict a table of interrupts 58 on the PRU 52. In one particular embodiment the $24^{th}$ interrupt 58-24 was selected as the interrupt used for the the received message or data signal from the EO/IR sensor 42 is transferred to processor 54. The $24^{th}$ interrupt 58-24 was selected because it was spaced adjacent to unused interrupts 58-23 and 58-25. Placing the interrupt as the $24^{th}$ interrupt 58-24 next to or immediately adjacent unused interrupts 58-23 and 58-25 should reduce the likelihood of confliction.

FIG. 8 is a table identifying the local data memory map for the first PRU 50 and the second PRU 52. The local data memory map allows each PRU 50, 52 to access the PRU-ICSS 38 addressable regions and the external host's memory map. The PRU accesses the external host memory map through the interface/OCP Master port. Memory addresses correspond to the PRU-ICSS 38 local address. When the EO/IR sensor 42 data signal or message arrives, the PRU processes that message and the interrupt is triggered. The PRU places the information or data into the shared memory address so that information or data may be used by the main processor 54. This table details what addresses are available for shared memory between the PRUS 50, 52 and the main processor 54. In this example, the memory address utilized for PRU 52 is the address 0x0000_2000 shown as "Data 8 KB Ram 0". Then, the main processor 54 is coded or programmed to access the shared memory at the identified mapped location or address.

Figure 9:
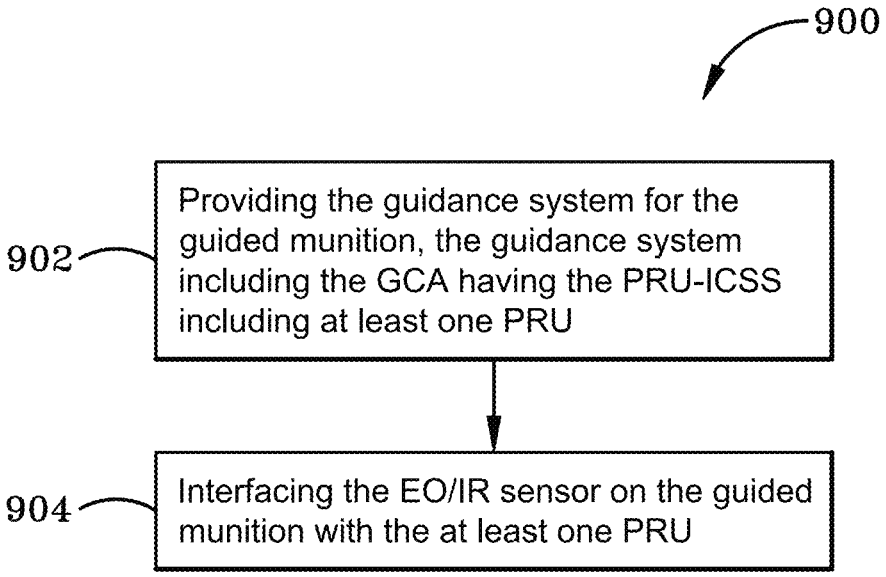
FIG. 9 (FIG. 9) is a flow chart depicting an exemplary method according to one aspect of the present disclosure.

FIG. 9 is a flowchart depicting an exemplary method 900 according to one aspect of the present disclosure. Method 900 may include providing the guidance system 30 for the guided munition 10, the guidance system 30 including the GCA 36 having the PRU-ICSS 38 including at least one PRU, which is shown generally at 902. Method 900 may also include interfacing the EO/IR 42 sensor on the guided munition 10 with the at least one PRU, which is shown generally at 904.

Method 900 may also include configuring at least one pin from a set of GPIO pins on the at least one PRU as a UART receiver; connecting the pin configured as the UART receiver with the EO/IR sensor; and effecting transmission of signals between the EO/IR sensor and the pin configured as the UART receiver. Method 900 may also include effecting pulsed signals to be received by the at least one PRU from the EO/IR.

Method 900 may also include configuring at least one pin from a set of GPIO pins on the at least one PRU as a UART receiver; connecting the pin configured as a UART receiver with the EO/IR sensor; and effecting transmission of signals from the pin configured as the UART receiver to a system interrupt controller that is part of the GCA. Method 900 may also include effecting, via the system interrupt controller, interruption of other signals in the GCA in response to the signals received from the pin configured as the UART receiver. Method 900 may also include effecting the signals received from the pin configured as the UART receiver to be placed into a shared memory address, wherein the shared memory address is shared and used by the at least two PRUs, wherein the at least one PRU is one of the at least two PRUs.

As described herein, aspects of the present disclosure may include one or more electrical or other similar secondary components and/or systems therein. The present disclosure is therefore contemplated and will be understood to include any necessary operational components thereof. For example, electrical components will be understood to include any suitable and necessary wiring, fuses, or the like for normal operation thereof. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A guidance computer assembly (GCA) for a guided munition, the GCA comprising:

a Programmable Real-Time Unit Industrial Communication SubSystem (PRU-ICSS) comprising a first Programmable Real-Time Unit (PRU) and a second PRU;

wherein the first PRU is programmed to receive and process input data from a first sensor on the guided munition; and wherein the second PRU is programmed to receive and process input data from a second sensor on the guided munition, wherein the second sensor is an electro-optical/infrared (EO/IR) sensor on the guided munition.

2. The GCA of claim 1, further comprising:

a set of General-Purpose Input/Output (GPIO) pins in at least the second PRU.

3. The GCA of claim 2, wherein at least one pin from the GPIO pins in the at least the second PRU is programmed as a Universal Asynchronous Receiver-Transmitter (UART) receiver.

4. The GCA of claim 1, wherein the second PRU communicates via Universal Asynchronous Receiver-Transmitter (UART) communications with the EO/IR sensor on the guided munition.

5. The GCA of claim 4, wherein the second PRU comprises:

a UART module in operative communication with the EO/IR sensor on the guided munition.

6. The GCA of claim 5, wherein the second PRU includes interrupts to handle signal reception from the EO/IR sensor on the guided munition.

7. The GCA of claim 6, further comprising unused interrupts in the second PRU, wherein the interrupt to handle signal reception from the EO/IR sensor on the guided munition is between two adjacent unused interrupts that are adapted to reduce confliction.

8. The GCA of claim 1, further comprising:

a memory map for the second PRU that triggers interrupts for the EO/IR sensor data according to memory map.

9. A guidance system for a guided munition, the guidance system comprising:

an inertial measurement unit (IMU) on the guided munition;

an electro-optical/infrared (EO/IR) sensor on the guided munition; and a guidance computer assembly (GCA) having a Programmable Real-Time Unit Industrial Communication SubSystem (PRU-ICSS), wherein the PRU-ICSS is in operative communication with the IMU and the EO/IR.

10. The guidance system of claim 9, further comprising:

seeker electronics on the guided munition; and a control actuator system on the guided munition.

11. The guidance system of claim 9, wherein the PRU-ICSS comprises:

a first Programmable Real-Time Unit (PRU), wherein the first PRU is programmed to receive and process input data from the IMU on the guided munition; and a second PRU, wherein the second PRU is programmed to receive and process input data from the EO/IR sensor on the guided munition.

12. The guidance system of claim 11, wherein the second PRU comprises:

a set of General-Purpose Input/Output (GPIO) pins, wherein at least one pin from the set of GPIO pins is programmed as a Universal Asynchronous Receiver-Transmitter (UART) receiver in operative communication with the EO/IR sensor on the guided munition.

13. The guidance system of claim 11, wherein the second PRU comprises:

a UART module in operative communication with the EO/IR sensor on the guided munition; and at least one interrupt to handle signal reception from the EO/IR sensor on the guided munition into the second PRU.

14. The guidance system of claim 11, wherein the second PRU comprises:

a memory map for the second PRU that triggers interrupts for the EO/IR sensor data according to memory map.

15. A guided munition comprising:

a thrust system near a tail end;

explosive material configured to detonate at or near an intended target;

an inertial measurement unit (IMU);

an electro-optical/infrared (EO/IR) sensor; and a guidance computer assembly (GCA) having a Programmable Real-Time Unit Industrial Communication SubSystem (PRU-ICSS), wherein the PRU-ICSS is in operative communication with the IMU and the EO/IR.

16. The guided munition of claim 15, wherein the PRU-ICSS comprises:

a first Programmable Real-Time Unit (PRU), wherein the first PRU is programmed to receive and process input data from the IMU; and a second PRU, wherein the second PRU is programmed to receive and process input data from the EO/IR sensor.

17. The guided munition of claim 16, wherein the second PRU comprises:

a set of General-Purpose Input/Output (GPIO) pins, wherein at least one pin from the set of GPIO pins is programmed as a Universal Asynchronous Receiver-Transmitter (UART) receiver in operative communication with the EO/IR sensor.

18. The guided munition of claim 16, wherein the second PRU comprises:

a UART module in operative communication with the EO/IR sensor on the guided munition; and at least one interrupt to handle signal reception from the EO/IR sensor on the guided munition into the second PRU.

19. The guided munition of claim 16, wherein the second PRU comprises:

a memory map for the second PRU that triggers interrupts for the EO/IR sensor data according to memory map.

20. The guided munition of claim 16, further comprising:

seeker electronics on the guided munition; and a control actuator system on the guided munition.

* * * * *